US010080914B1

(12) United States Patent
Kessler et al.

(10) Patent No.: US 10,080,914 B1
(45) Date of Patent: Sep. 25, 2018

(54) EXERCISE AND PLAY HOOP

(71) Applicant: Kessler Corporation, Los Angeles, CA (US)

(72) Inventors: Alexander Wylie Kessler, Los Angeles, CA (US); Brian Kessler, Los Angeles, CA (US)

(73) Assignee: KESSLER CORPORATION, Los Angeles, CA (US)

( * ) Notice: Subject to any disclaimer, the term of this patent is extended or adjusted under 35 U.S.C. 154(b) by 0 days.

(21) Appl. No.: 15/496,395

(22) Filed: Apr. 25, 2017

(51) Int. Cl.
*A63B 19/00* (2006.01)

(52) U.S. Cl.
CPC ..... *A63B 19/00* (2013.01); *A63B 2208/12* (2013.01)

(58) Field of Classification Search
CPC ..... A63B 19/00; A63B 2208/12
USPC ..... 446/26, 28, 236
See application file for complete search history.

(56) References Cited

U.S. PATENT DOCUMENTS 4,020,589 A * 5/1977 Bravence ..... A63H 33/02 446/450
4,052,982 A * 10/1977 Ozeryansky ..... A61H 7/00 446/236
5,342,273 A * 8/1994 Plendl ..... A63B 19/00 482/122
5,895,309 A * 4/1999 Spector ..... A63B 19/00 446/220
5,997,449 A * 12/1999 Lee ..... A61H 15/00 446/236
6,309,273 B1 * 10/2001 Kim ..... A63B 19/00 446/236
6,431,939 B1 * 8/2002 Roh ..... A61H 7/00 446/236
6,450,854 B1 * 9/2002 Fireman ..... A63B 19/00 446/236
6,890,238 B2 * 5/2005 Kessler ..... A63B 19/00 446/236
7,566,255 B2 * 7/2009 Kessler ..... A63B 19/00 446/236
7,862,488 B2 * 1/2011 Albanese ..... A63B 19/00 446/236
8,025,549 B2 * 9/2011 Kim ..... A61H 39/04 446/107
9,345,920 B2 * 5/2016 Seroussi ..... A63B 19/00
2003/0148702 A1 * 8/2003 Campbell ..... A63B 19/00 446/236
2005/0070202 A1 * 3/2005 Mendel ..... A63B 19/00 446/236
2010/0029446 A1 * 2/2010 Munoz ..... A63B 15/00 482/78

(Continued)

*Primary Examiner* — Alexander Niconovich
(74) *Attorney, Agent, or Firm* — Browdy and Neimark, P.L.L.C.

(57) ABSTRACT

A play and/or exercise hoop includes an inner wall having a top edge and a bottom edge and an outer wall having a top edge and a bottom edge. A bottom edge of the outer wall is attached to the bottom edge of the inner wall to define a bottom edge of the hoop. A rounded top-portion is attached to the top edge of the inner wall and a top edge of the outer wall. The hoop may have an iridescent film or transparent film bonded to its outer surfaces.

The inner wall and outer walls are angled relative to a central axis of the hoop thereby defining a V-shaped bottom edge. The inner and outer walls may be flat or may have a slight curve relative to the top portion thereby defining a tear-dropped shape.

19 Claims, 8 Drawing Sheets

(56) References Cited

U.S. PATENT DOCUMENTS

2012/0196501 A1* 8/2012 Kessler ..... A63B 19/00
446/236

* cited by examiner

EXERCISE AND PLAY HOOP

FIELD OF INVENTION

The present invention relates to play and/or exercise hoops.

BACKGROUND

Play hoops, often referred to as "hula hoops", for rotation about the body are widely known, and used for gyrating around the hips and other parts of the body. These hoops are typically made from a length of plastic tubing having a circular cross-section. The tubing is shaped in a circle and the ends are joined to form the hoop. Decoration is commonly provided with colored plastic and colorful patterns.

Many people have difficulty learning to use these types of hoops. This can be for a variety of reasons but inevitably the circular hoop slips down past the user's hips and falls to the ground. The process can be frustrating, particularly for the beginner.

SUMMARY OF INVENTION

The present invention is directed to a play and/or exercise hoop. In one general aspect, a play and/or exercise hoop includes an inner wall having a top edge and a bottom edge and an outer wall having a top edge and a bottom edge. The bottom edge of the outer wall is attached to the bottom edge of the inner wall to define a bottom edge of the hoop. A rounded top-portion is attached to the top edge of the inner wall and a top edge of the outer wall.

Embodiments may include one or more of the following features. For example, a first plane defining the surface of the inner wall and a second plane defining a surface of the outer wall are at an angle relative to a central axis of the hoop. The inner wall and the outer wall define a v-shaped configuration extending from the bottom edge of the hoop to the attachment with the rounded top-portion.

The inner wall of the hoop may have a high friction surface that makes contact with the user thereby helping to prevent the hoop from slipping down the body of the user.

The hoop may be a continuous circle made from a tube segment that is joined together. Thus, it may typically be hollow.

The hoop may have an iridescent film or transparent film bonded to its outer surfaces.

The inner wall and/or the outer wall may be flat and angled relative to a central axis of the hoop. The angle of the inner wall creates increased surface area and additional friction between the hoop and the user. By "flat", what is meant is a surface which is flat in cross-section even though curved about the hoop.

DETAILED DESCRIPTION OF THE DRAWINGS

DETAILED DESCRIPTION OF EMBODIMENTS

Figure 1:
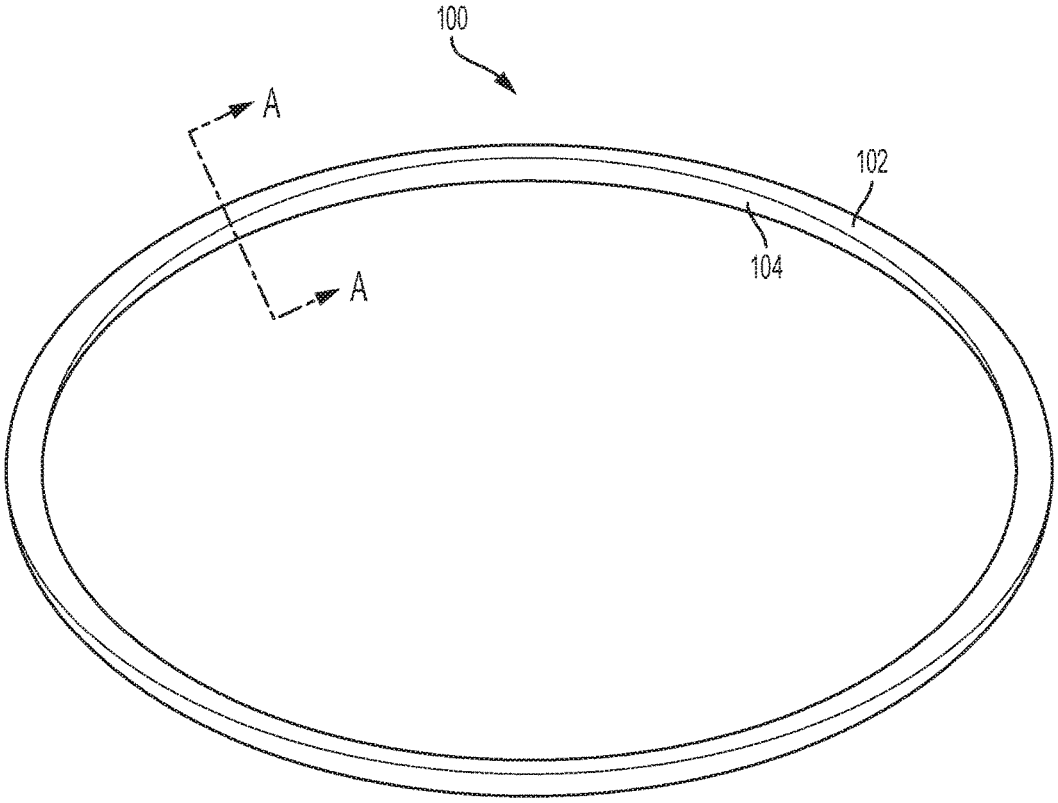
FIG. 1 shows a perspective view of a hoop with a rounded top-portion facing up in accordance with the present invention.

Referring to FIGS. 1-4, a hoop 100 includes a rounded top portion 102 that is attached to an inner wall 104 and an outer wall 106 that converge to a V-shaped bottom edge 108. The hoop is formed from a length of tubing that is bent into a circular shape and the two ends joined (not shown).

Figure 2:
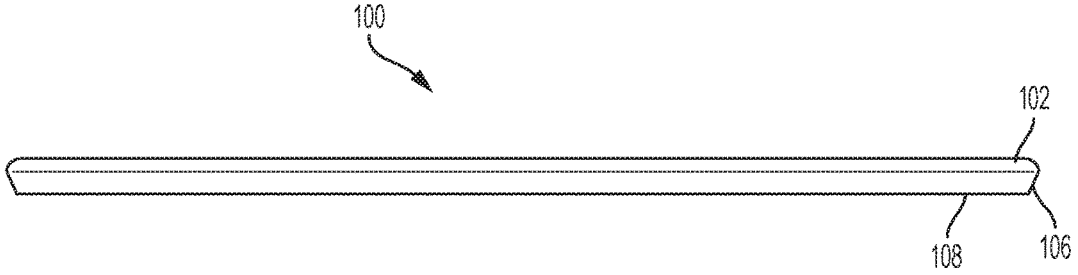
FIG. 2 shows a side view of the hoop of FIG. 1.
Figure 3:
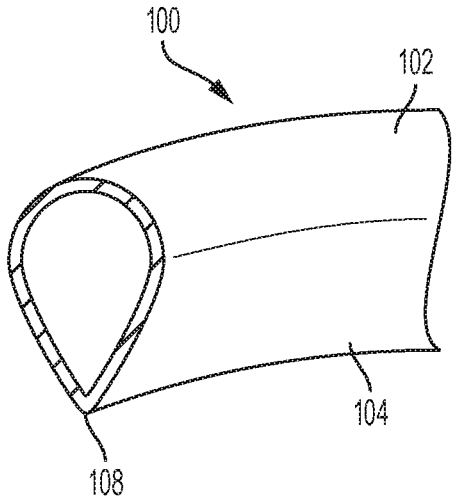
FIG. 3 shows a cross-sectional view of the hoop along lines A-A of FIG. 1.
Figure 6:
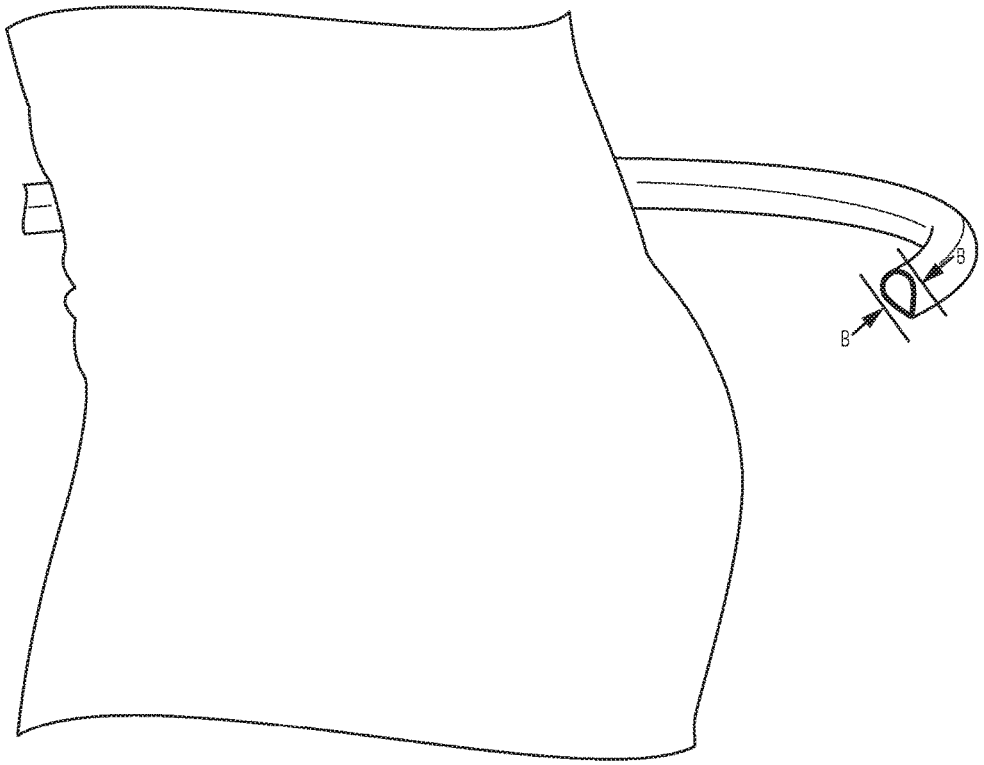
FIG. 6 shows a cross-section of the hoop in relation to the trunk of the user.

FIG. 2 is a side view of the hoop 100 showing the rounded top portion 102, the outer wall 106 and the V-shaped bottom edge 108. FIG. 3 is a cross-sectional view of the hoop 100 along the line A-A of FIG. 1. The rounded top portion 102 is attached to the inner wall 104 that converges to the bottom V-shaped edge 108. Referring to FIG. 6, the inner wall 104 and the outer wall 106 have a dimension of approximate ¾ of an inch as shown by Dimension B. In other embodiments the inner and outer walls 104, 106 may have dimensions ranging from 0.5-1.0 inches. As shown, the hoop is hollow, however, in different embodiments the inside of the hoop may be a solid composition or may be filled with solid matter, such as, for example, water or a counter weight.

Figure 4:
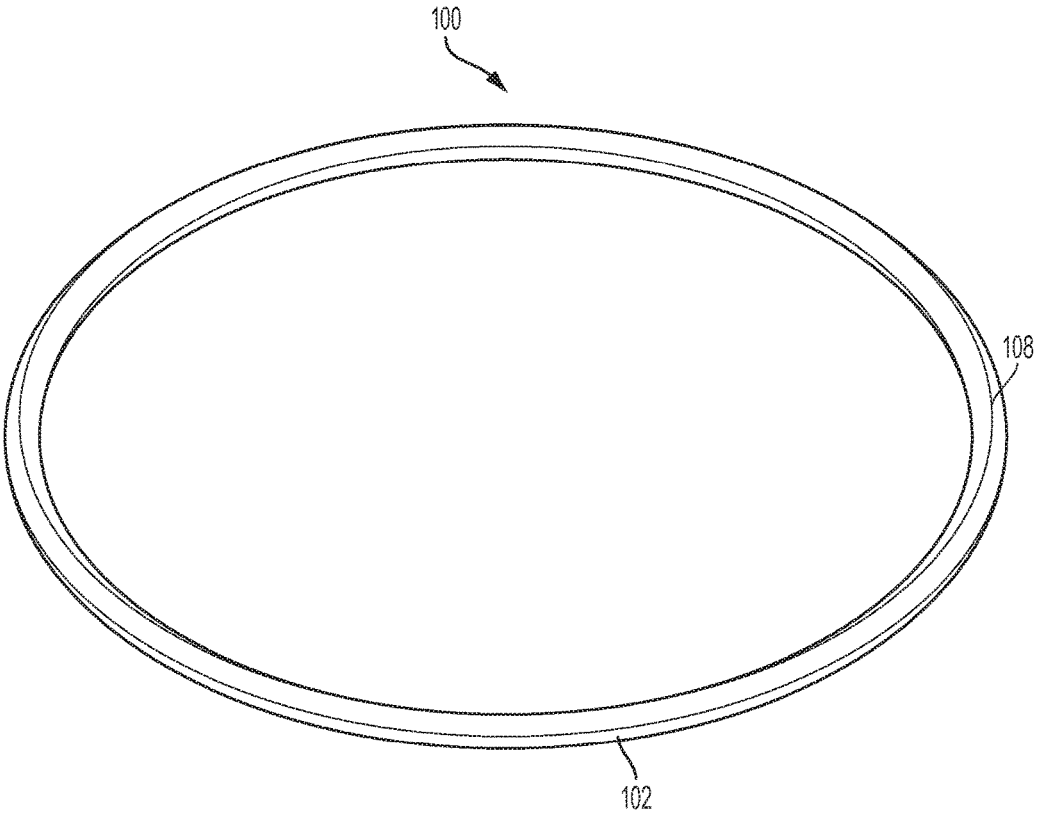
FIG. 4 is a perspective view of the hoop of FIG. 1 with the rounded portion facing down.

FIG. 4 is a perspective view of the hoop 100 with the V-shaped edge 108 facing up and the rounded portion 102 facing down.

The hoop 100 is formed from a semi-rigid plastic, such as, for example, extruded polyethylene or polyethylene terephthalate glycol, the latter being a type of thermoplastic polyester. The thickness of the hollow hoop 100 may depend on a desired weight and amount of rigidity. The diameter of the hoop 100 may range from 32-39 inches for youth or advanced adult hoopers. Mid-size hoops 100 may be approximately 36-42 inches in diameter. Large hoops 100 are typically 42 inches or larger. However, the diameter of the hoop can vary significantly based on the height and ability of the user. Typically, hoops 100 may weigh from about 0.2 to 2.5 pounds.

Figure 5:
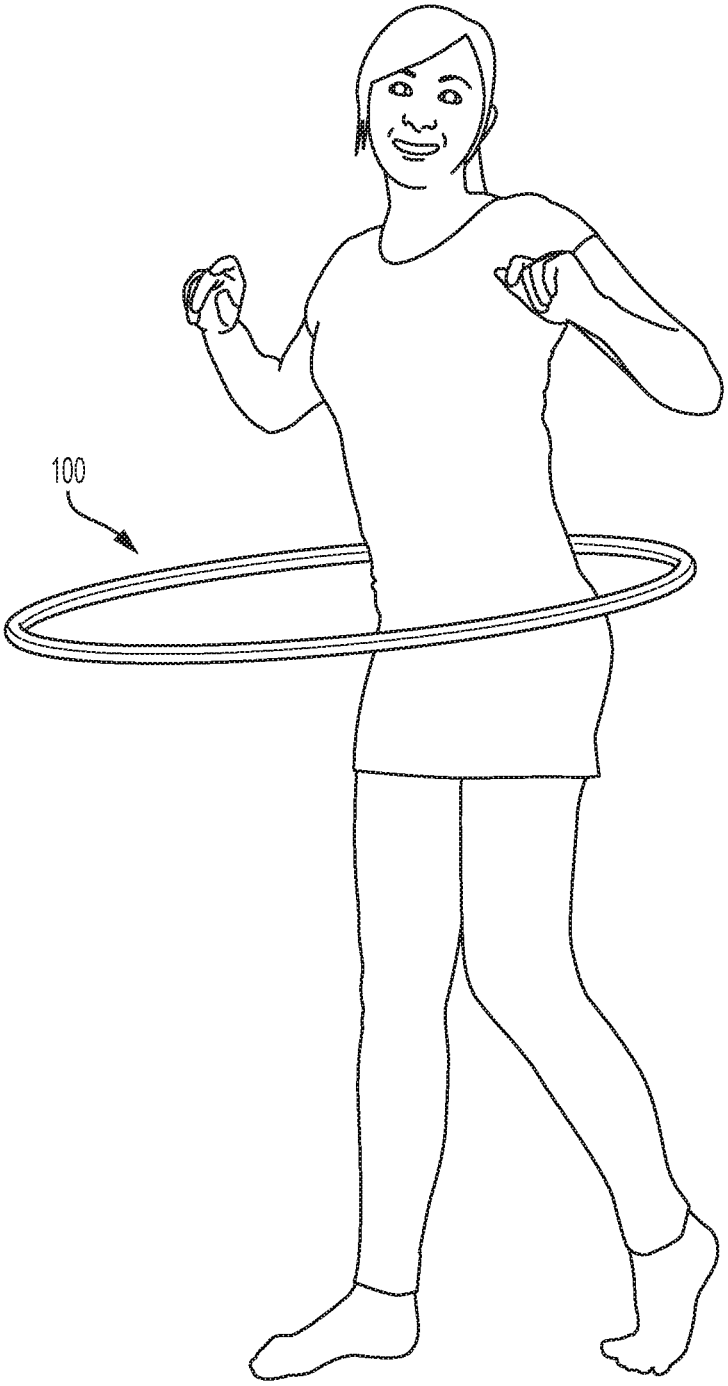
FIG. 5 shows a user playing with the hoop.

Referring to FIG. 5, the user can grab around the ergonomic V-shape of the hoop 100 and rotate it around her hips. The user continues the momentum of the hoop by moving her hips and midsection in a front to back, side to side or push-pull motion which maintains the hoop in a circular motion.

As shown in FIG. 6, the inner wall 104 rides along the user's hips. In the embodiment as show, the inner wall 104 is flat instead and angled to mate with a larger area of the user's hips, there is additional surface friction between the user and the inner flat wall 104 of the hoop. The surface friction may also be enhanced with a roughened surface, a fabric, friction tape and/or rubberized hemispherical bumps bonded to the inner flat wall 104 (not shown).

Figure 7:
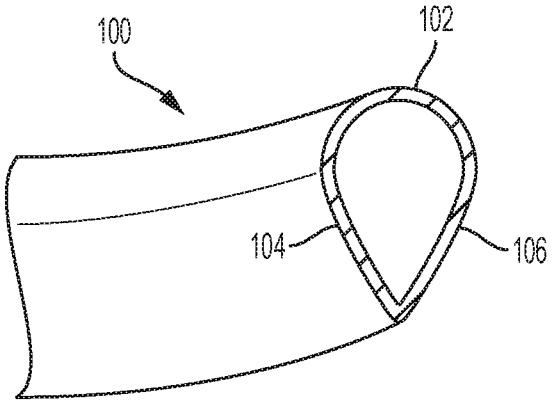
FIG. 7 is another embodiment of a cross-section of the hoop.
Figure 8:
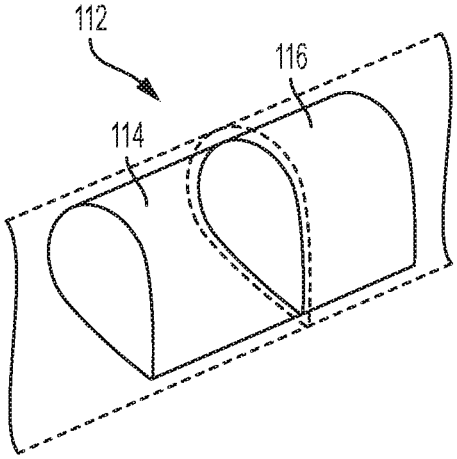
FIG. 8 is a connector plug that joins both ends of a segment of tubing to form the hoop.

In another embodiment as shown in FIG. 7, the inner wall 104 and the outer wall 106 have a slight curve relative to the top portion 104 thereby defining a tear drop cross-sectional view. Once again, the tear drop shape of the inner wall 104 creates more surface area in contact with the body of the user. Referring to FIG. 8, a connector 112 is used to attach the two ends of a segment of tubing to form the hoop 100. The connector has a first end 114 and a second end 116 and a rib 118 between the first and second ends 114, 116. The two ends of a tube segment are pushed onto the first and second end 114, 116 and butt up against the rib 118. The ends 114, 116 are then bonded or glued in place.

A decorative iridescent film may be bonded to the outside of the hoop. The iridescent film is transparent so that it accents or enhances the base color of the hoop.

The above description of various embodiments reveals the general nature of the invention so that others can readily modify and/or adapt for various applications other embodiments without departing from the concept, and, therefore, such adaptations and modifications are within the scope of the claims and equivalents. The terminology used herein is for the purpose of description and not of limitation. The means, materials, and steps for carrying out various disclosed functions may take a variety of alternative forms without departing from the invention.

The invention claimed is:

1. A play and/or exercise hoop, comprising:

an inner wall having a top edge and a bottom edge;

an outer wall having a top edge and a bottom edge, wherein the bottom edge of the outer wall is attached to the bottom edge of the inner wall to define a bottom edge of the hoop and the inner wall and the outer wall define a v-shaped cross-section with an orientation of the inner wall and the outer wall defining a set of equal angles relative to a central axis of the hoop; and a rounded top-portion attached to the top edge of the inner wall and a top edge of the outer wall;

wherein an orientation of a line connecting the point where the outer wall and inner wall are attached and a point at a top of the rounded top-portion define a vertical axis that is parallel to the central axis of the hoop.

2. The hoop of claim 1, wherein a cross-section view of inner wall, outer wall and rounded top portion defines a tear drop shape.

3. The hoop of claim 1, wherein the hoop extends in a round circle.

4. The hoop of claim 1, wherein the inner wall comprises a high friction surface relative to other surfaces of the hoop.

5. The hoop of claim 1, further comprising an iridescent film bonded to the rounded top-portion, inner wall and outer wall thereby accenting a base color of the hoop.

6. The hoop of claim 1, wherein the hoop comprises a transparent film bonded to outer surfaces of the rounded top-portion, inner wall and outer wall.

7. The hoop of claim 1, wherein the inner wall comprises a flat inner wall.

8. The hoop of claim 1, wherein the outer wall comprises a flat outer wall.

9. The hoop of claim 1, wherein the inner wall comprises an angled inner wall that causes more surface area of the inner wall to remain in contact with a user.

10. The hoop of claim 1, wherein the rounded top-portion defines a convex curve and the inner wall and the outer wall define straighter surfaces relative to the rounded top-portion thereby define a tear dropped shape cross-sectional view of the hoop.

11. The hoop of claim 1, wherein the hoop is hollow.

12. The hoop of claim 1, wherein a height of the inner wall and a height of the outer wall comprises more than ½ inch.

13. The hoop of claim 1, wherein the hoop comprise a tube segment with a first end and a second end and further comprising a connector having a first portion and a second portion, wherein the connector receives the first end and the second end of the tube segment to define a circular hoop.

14. The hoop of claim 13, wherein the connector further comprises a rib between the first portion and the second portion and wherein the first end and the second end butt up against the rib.

15. A circular hoop, comprising:

an inner wall having a top edge and a bottom edge;

an outer wall having a top edge and a bottom edge, wherein the bottom edge of the outer wall is attached to the bottom edge of the inner wall to define a bottom edge of the hoop; and a rounded top-portion attached to the top edge of the inner wall and a top edge of the outer wall;

wherein a first plane defining a surface of the inner wall and a second plane defining a surface of the outer wall comprise a V-shaped angle relative to a central axis of the hoop;

a cross-section view of inner wall, outer wall and rounded top portion defines a tear drop shape; and an orientation of a line connecting the point where the outer wall and inner wall are attached and a point at a top of the rounded top-portion define a vertical axis that is parallel to the central axis of the hoop.

16. A circular hoop, comprising:

an inner wall having a top edge and a bottom edge;

an outer wall having a top edge and a bottom edge, wherein the bottom edge of the outer wall is attached to the bottom edge of the inner wall to define a bottom edge of the hoop; and a rounded top-portion attached to the top edge of the inner wall and a top edge of the outer wall;

wherein a first plane defining a surface of the inner wall and a second plane defining a surface of the outer wall comprise a V-shaped angle relative to a central axis of the hoop;

a cross-section view of inner wall, outer wall and rounded top portion defines a tear drop shape; and wherein a line connecting the top edge of the inner wall to the top edge of the outer wall defines a horizontal plane that is perpendicular to the central axis of the hoop.

17. A play and/or exercise hoop, comprising:

an inner wall having a top edge and a bottom edge;

an outer wall having a top edge and a bottom edge, wherein the bottom edge of the outer wall is attached to the bottom edge of the inner wall to define a bottom edge of the hoop and the inner wall and the outer wall define a v-shaped cross-section with an orientation of the inner wall and the outer wall defining a set of equal angles relative to a central axis of the hoop; and a rounded top-portion attached to the top edge of the inner wall and a top edge of the outer wall wherein a line connecting the top edge of the inner wall to the top edge of the outer wall defines a horizontal plane that is perpendicular to the central axis of the hoop.

18. A play and/or exercise hoop, comprising:

an inner wall having a top edge and a bottom edge;

an outer wall having a top edge and a bottom edge, wherein the bottom edge of the outer wall is attached to the bottom edge of the inner wall to define a bottom edge of the hoop and the inner wall and the outer wall define a v-shaped cross-section with an axis of symmetry that is parallel to a central axis of the hoop; and a rounded top-portion attached to the top edge of the inner wall and a top edge of the outer wall.

19. A circular hoop, comprising:

an inner wall having a top edge and a bottom edge;

an outer wall having a top edge and a bottom edge, wherein the bottom edge of the outer wall is attached to the bottom edge of the inner wall to define a bottom edge of the hoop; and a rounded top-portion attached to the top edge of the inner wall and a top edge of the outer wall;

wherein a first plane defining a surface of the inner wall and a second plane defining a surface of the outer wall comprise a V-shaped angle with an axis of symmetry that is parallel to a central axis of the hoop; and a cross-section view of inner wall, outer wall and rounded top portion defines a tear drop shape.

* * * * *